US011781455B2

(12) United States Patent
Tkachuk

(10) Patent No.: US 11,781,455 B2
(45) Date of Patent: Oct. 10, 2023

(54) EXHAUST FILTER SYSTEM FOR INTERNAL COMBUSTION ENGINES AND METHOD OF USING SAME

(71) Applicant: The Original Carbon Trap Inc., Onoway (CA)

(72) Inventor: Kevin Tkachuk, Onoway (CA)

(73) Assignee: The Original Carbon Trap Inc., Onoway (CA)

( * ) Notice: Subject to any disclaimer, the term of this patent is extended or adjusted under 35 U.S.C. 154(b) by 0 days.

(21) Appl. No.: 17/750,079

(22) Filed: May 20, 2022

(65) Prior Publication Data

US 2022/0372901 A1 Nov. 24, 2022

Related U.S. Application Data

(60) Provisional application No. 63/190,834, filed on May 20, 2021.

(51) Int. Cl.

| | |
|---|---|
| ***F01N 3/02*** | (2006.01) |
| ***F01N 3/021*** | (2006.01) |
| ***F01N 3/022*** | (2006.01) |

(52) U.S. Cl.

CPC ..... *F01N 3/0211* (2013.01); *F01N 3/0226* (2013.01); *F01N 2330/102* (2013.01); *F01N 2330/20* (2013.01); *F01N 2450/30* (2013.01)

(58) Field of Classification Search

CPC ..... F01N 3/0211; F01N 3/0226; F01N 2330/102; F01N 2330/20; F01N 2450/30

See application file for complete search history.

(56) References Cited

U.S. PATENT DOCUMENTS

| | | | | |
|---|---|---|---|---|
| 3,869,267 | A * | 3/1975 | Gaylor | F01N 3/0211 55/505 |
| 5,585,081 | A | 12/1996 | Chu et al. | |
| 7,329,298 | B1 | 2/2008 | Hasinski | |
| 7,578,979 | B2 | 8/2009 | Alward et al. | |
| 7,849,680 | B2 | 12/2010 | Shaft et al. | |
| 8,114,201 | B2 | 2/2012 | Gebert et al. | |

(Continued)

FOREIGN PATENT DOCUMENTS

| | | | |
|---|---|---|---|
| DE | 101 48 180 | A1 | 4/2003 |
| DE | 10 2005 042 207 | A1 | 3/2007 |
| JP | 2012-130853 | A | 7/2012 |

OTHER PUBLICATIONS

WFS, Aerostar-Filter Media-1"X36" X120 FT White-18689, 2020 (Year: 2020).*

*Primary Examiner* — Audrey B. Walter
(74) *Attorney, Agent, or Firm* — Finch & Maloney PLLC

(57) ABSTRACT

A device that filters particulate matter from the exhaust stream of an engine includes a supporting structure with an elongate support, and a filter sleeve disposed within an exterior sleeve;

a filter sleeve comprising a tubular shaft of filter material, the shaft having an open first end, and a closed second end;

an exterior sleeve comprising a tubular shaft that defines an internal cavity that is sized and proportioned to receive the filter sleeve, the tubular shaft having an open first end, and a substantially closed second end, the substantially closed second end having a hole for filtered exhaust gases to pass through; and an attachment member that mounts the exterior sleeve to the supporting structure.

16 Claims, 6 Drawing Sheets

(56) References Cited

U.S. PATENT DOCUMENTS

| | | | | |
|---|---|---|---|---|
| 8,191,668 | B2 | 6/2012 | Keane et al. | |
| 2007/0084199 | A1* | 4/2007 | Whitaker | F01N 13/082 60/297 |
| 2008/0053068 | A1* | 3/2008 | Sangiovani | F01N 3/0335 60/282 |
| 2010/0199843 | A1 | 8/2010 | Sangiovani | |
| 2011/0247310 | A1 | 10/2011 | Hahnl et al. | |
| 2018/0369734 | A1* | 12/2018 | Aneke | B01D 46/4236 |

* cited by examiner

EXHAUST FILTER SYSTEM FOR INTERNAL COMBUSTION ENGINES AND METHOD OF USING SAME

FIELD

The present disclosure relates generally to the field of filter systems, specifically to exhaust systems for internal combustion engines, more specifically to stand-alone exhaust filter systems for internal combustion engines.

BACKGROUND

Internal combustion engines combust hydrocarbon fuel to generate power, such as motive power (as in the case of a motor) or electrical power (as in the case of a generator). The combustion products will depend on the type of fuel and the efficiency and type of motor. However, most engines will produce some fumes and particulate matter in the exhaust stream, in addition to carbon dioxide, water vapor, and nitrogen. Various different devices exist that attempt to purify, render innocuous, or otherwise treat exhaust fumes, or remove solid constituents by means of filters, examples of which may be found in the following patent documents:

a. Japanese application no. JP2012130853 (Katsuki et al.) entitled "Bag filter, and exhaust gas treatment apparatus"
b. German patent no. DE10148180 (Katzenwadel et al.) entitled "Device for purifying exhaust gases on diesel engine testing stands comprises a suction unit for introducing the exhaust gas to a dry dust filter system, and a purification unit for purifying the dry dust filter system"
c. U.S. Pat. No. 7,578,979 (Alward et al.) entitled "Ceramic diesel exhaust filters"
d. U.S. Pat. No. 8,191,668 (Keane et al.) entitled "Mounting assembly for emissions control system"
e. U.S. Pat. No. 8,114,201 (Gebert et al.) entitled "Air pollution control filter elements for filtration systems"
f. German patent application no. DE102005042207 (Suter et al.) entitled "Particle filter bag for use in internal combustion engine, has filter surfaces, which limits hollow space of bag and enlarge around additional filter surfaces at inflow and outflow sides, where spacer is accommodated in hollow space"
g. U.S. Pat. No. 5,585,081 (Chu et al.) entitled "SOx, NOx and particulate removal system"
h. United States pregrant pub. no. US20100199843 (Sangiovani) entitled "Impact diesel particulate filter"
i. U.S. Pat. No. 7,849,680 (Shaff et al.) entitled "Diesel particulate filter system for auxiliary power units"
j. United States pregrant pub. no. US20080053068 (Sangiovani) entitled "Device & Method for the Reduction of Emissions"
k. U.S. Pat. No. 7,329,298 (Hasinki) entitled "Filter"
l. United States pregrant pub. no. US20110247310 (Hahnl) entitled "Exhaust gas treatment device for an exhaust gas system and method of manufacturing an exhaust gas treatment device"

SUMMARY

According to an aspect, there is provided an exhaust filter system for internal combustion, such as motors, generators and the like, and method of using same.

According to an aspect, there is provided a device for filtering particulate matter from exhaust gases, the device comprising: a supporting structure comprising a hollow tubular collar attached to an elongate support; a filter sleeve comprising a tubular shaft of filter material, the shaft having an open first end, having a diameter larger than a diameter of the hollow tubular collar, and a closed second end; an exterior sleeve, sized and proportioned to accommodate the filter sleeve, the exterior sleeve comprising a tubular shaft of fabric material, the shaft having an open first end, having a diameter larger than the diameter of the filter sleeve, and an essentially closed second end having a hole for filtered exhaust gases to pass through; and an attachment member to connect the exterior sleeve to the hollow tubular collar.

In accordance with another aspect of the invention there is provided a method of removing particulate matter from exhaust gases, the method comprising: assembling the device as described herein; and positioning the elongate support and fixing the hollow tubular collar in line with an exhaust pipe emitting exhaust gases.

In accordance with yet another aspect of the invention there is provided a kit for the construction of a device for filtering particulate matter from exhaust gases, the kit comprising: a supporting structure comprising a hollow tubular collar attached to an elongate support; one or more filter sleeves comprising a tubular shaft of filter material, the shaft having an open first end, having a diameter larger than a diameter of the hollow tubular collar, and a closed second end; an exterior sleeve, sized and proportioned to accommodate one of the one or more filter sleeves, the exterior sleeve comprising a tubular shaft of fabric material, the shaft having an open first end, having a diameter larger than the diameter of the one of the one or more filter sleeves, and an essentially closed second end having a hole for filtered exhaust gases to pass through; and an attachment member to connect the exterior sleeve to the hollow tubular collar.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

As used herein, the term "engine" is intended to refer to an internal combustion engine, or in other words, an engine that relies on burning fuel, such as hydrocarbon fuel, to generate power. An engine may be employed as a motor that drives a piece of equipment such as a water pump, as part of a generator to generate electricity, etc. The engine may be part of portable or stationary equipment Examples that will be discussed herein relate to a device that may be installed adjacent to an engine exhaust outlet to collect and filter particulate matter from exhaust emissions. A stand holds the unit in place adjacent to the exhaust outlet of the engine. The device also has a filter and bag system. The filter may be placed inside a bag or holder and mounted to the metal stand, which is then placed adjacent to the exhaust outlet. As the engine runs, the exhaust gases exiting the exhaust outlet flow through the bag and particulate emissions are collected and filtered before entering the environment.

Figure 1:
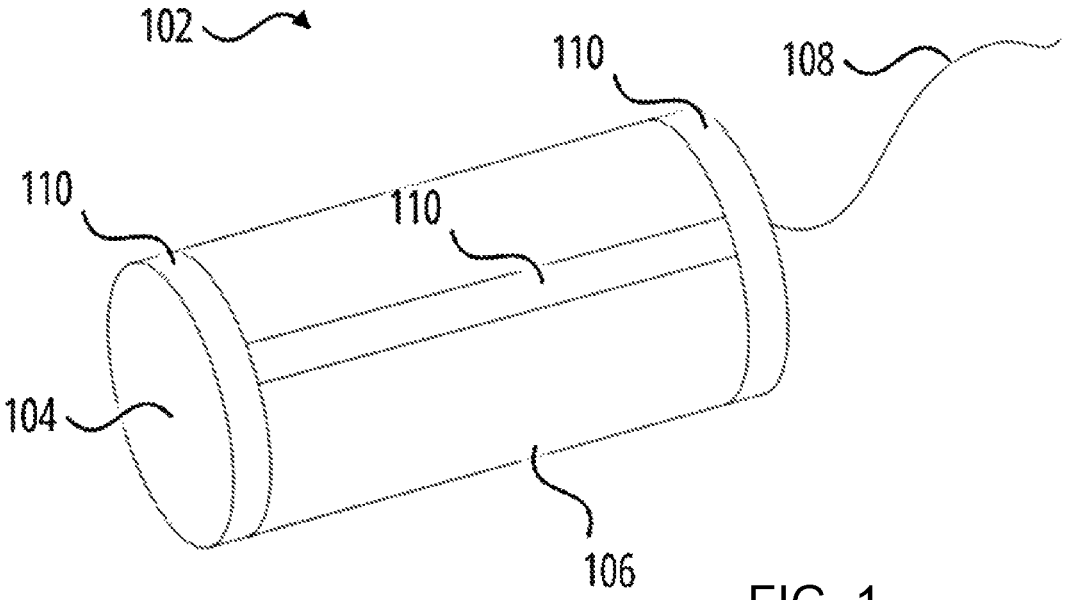
FIG. 1 is a perspective view of a filter.

Referring now to FIG. 1, a filter sleeve 102 is depicted that may be fabricated from a polyester filter material. The depicted filter sleeve 102 is formed as a tubular body having an open influx end 104 and a cylindrical wall 106. If formed from a sheet of material that is rolled into a cylinder, the resulting seam may be covered by cotton edging tape 110, or otherwise secured. A cord 108 may be attached to filter sleeve 102. Filter sleeve may also be manufactured as a continuous shape.

A suitable material for filter sleeve 102 may be under the trademark Glasfloss™ which is manufactured from 100% non-woven polyester fibers bonded together. The polyester material may be supplied in pre-cut pads that are machined into the required shape and size. The polyester may be manufactured from a series of single or multi-ply grades and may be available dry or treated with a non-toxic, non-migratory, odorless adhesive that is incorporated into the filter media. In one example, adequate performance was obtained using non-woven polyester fibers bonded together to produce in the region of 0.11 wg @ 300 fpm.

Figure 2:
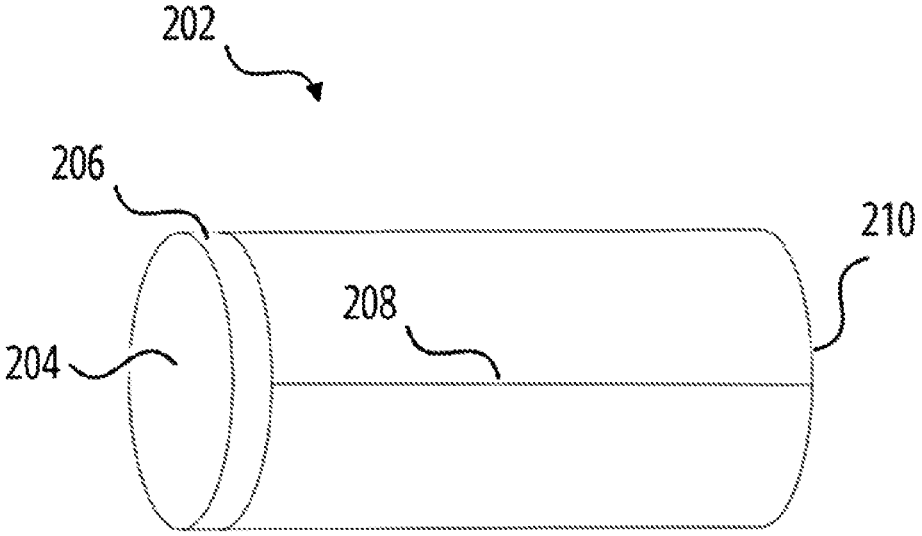
FIG. 2 is a front perspective view of a filter sleeve.

Referring to FIG. 2, an exterior sleeve 202 is shown. Exterior sleeve 202 may be fabricated from a gas permeable material, such as cotton, canvas, linen, or denim. The exterior sleeve 202 may be designed as a tubular with an edge seam 208 if sleeve 202 is manufactured from a sheet of material, and is sized and proportioned to encompass tubular filter sleeve 102. Exterior sleeve 202 has an open end 204 that may be surrounded by a tubular seam 206. The opposing end of the exterior sleeve 202 may be an essentially closed end 210, such that the exhaust flow is forced through the sidewall.

Figure 3:
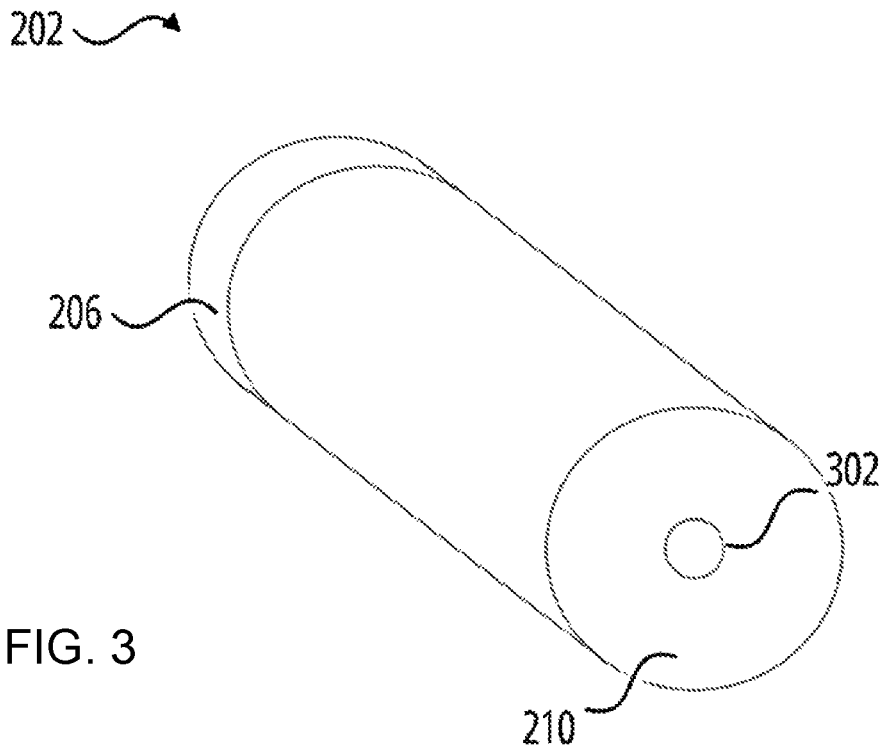
FIG. 3 is a rear perspective view of the filter sleeve.

Referring to FIG. 3, a rear perspective view of the exterior sleeve 202 is shown detailing the essentially closed end 210, having a hole 302 centrally positioned that is opposite open end 204.

Figure 6:
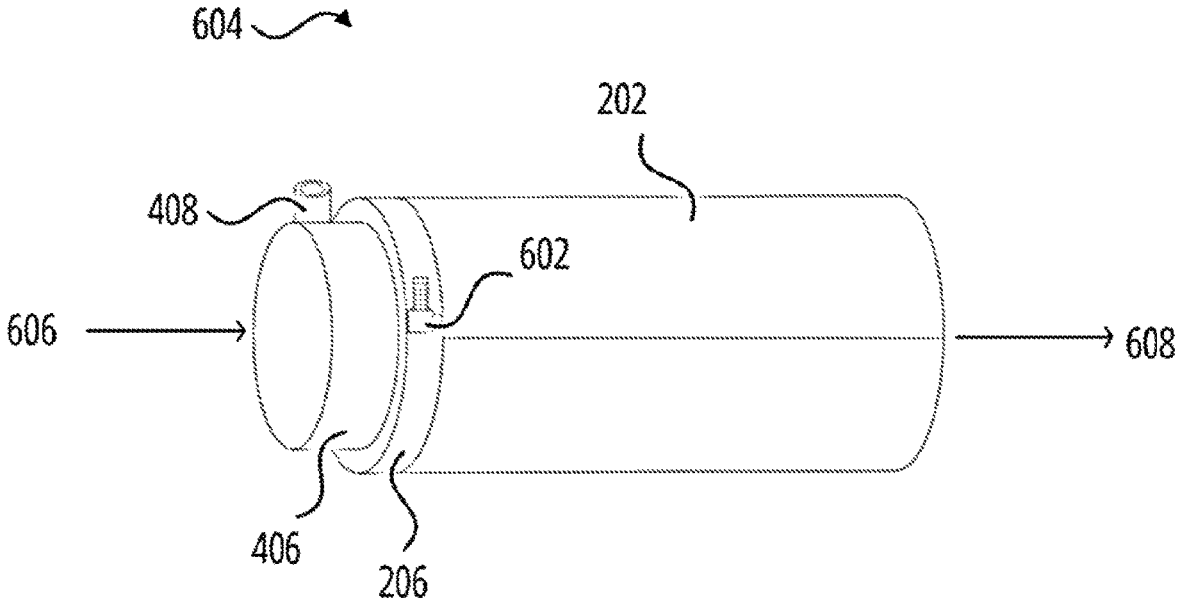
FIG. 6 is a perspective view of an assembled filter and filter sleeve.

Referring to FIG. 6, a perspective view of an assembled filter device 604 is shown, where filter sleeve 102 has been inserted into exterior sleeve 202. and secured in position by way of a fastening member 602 that is threaded through a tubular seam 206 that encompasses the outer perimeter of the exterior sleeve 202. Alternatively, fastening member 602 may be a zip tie or other fastener. The exhaust influx 606 enters into the open end 204 of the filter sleeve 102 and exterior sleeve 202 combination. The exhaust efflux 608 exits the filter sleeve 102 and exterior sleeve 202 combination. A tubular support 408 can be seen affixed to an outer surface of the collar 406.

Figure 7:
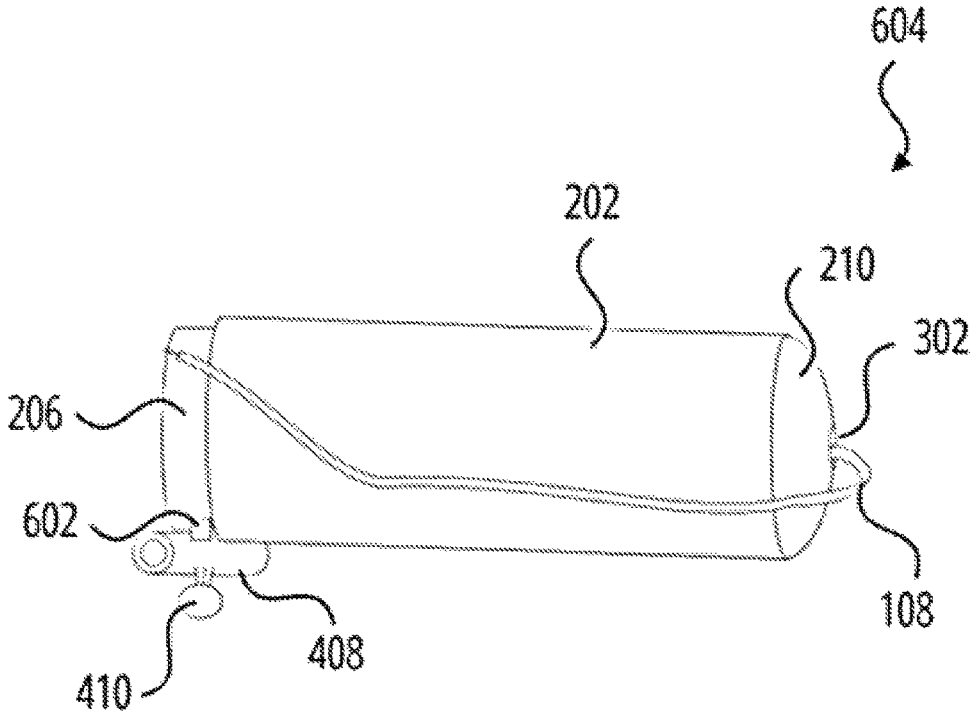
FIG. 7 is a top perspective view of the filter and filter sleeve mounted to the supporting structure.

Referring to FIG. 7, another perspective view of assembled filter device 604 is shown, depicting essentially closed end 210. Essentially closed end 210 may have a hole 302 to allow exhaust gases to pass through after particulate matter has been removed by the filter sleeve 102 (not shown). If filter sleeve 102 has a cord 108, cord 108 may be threaded through hole 302 and then pulled to assist with insertion of filter sleeve 102 inside the exterior sleeve 202. The end of cord 108 may be weighted (not shown) to assist with alignment.

Figure 4:
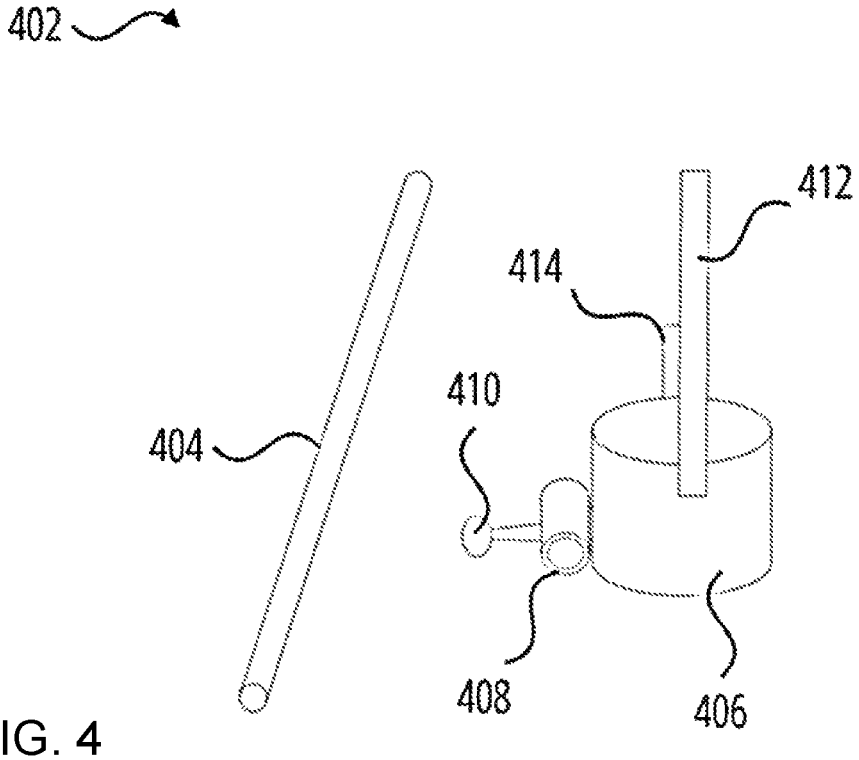
FIG. 4 is a perspective view of a disassembled supporting structure.
Figure 5:
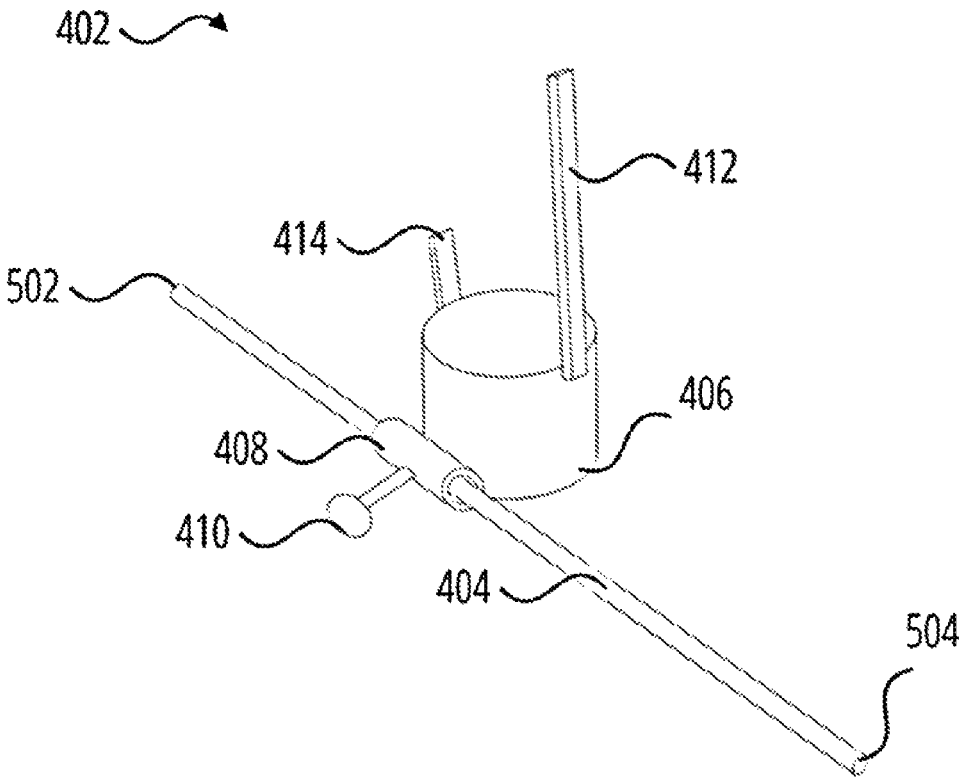
FIG. 5 is a perspective view of an assembled supporting structure.

Referring to FIG. 4, an example of supporting hardware 402 is shown that is used to support assembled filter device 604, when as shown in FIG. 5. In the illustrated example, supporting hardware 402 includes an elongate support, such as a pole 404, a collar 406, a tubular pole support 408, and an adjustment member 410. Collar 406 may have a smaller diameter than the internal diameter of filter sleeve 102 and exterior sleeve 202 combination. Collar 406 may have a tubular pole support 408 attached to an outer surface of the collar 406. Tubular pole support 408 may be sized to accommodate pole 404 and an adjustment member 410, shown in this example as a thumb screw, which secures collar 406 to pole 404 at an adjustable height. There may be an upper filter support 412 that extends longitudinally from an inner edge of collar 406 and extends into assembled filter device 604. There may also be a lower filter support 414 that extends longitudinally from an inner edge of the collar 406 that also extends into assembled filter device 604.

Referring to FIG. 5, pole 404 is shown fixed in place on tubular pole support 408 by way of adjustment member 410 between upper end 504 and lower end 502 of pole 404. Lower end 502 of the pole 404 may be pushed into the ground when used on soft ground, or attached to a stand 806 as shown in FIG. 8.

Figure 8:
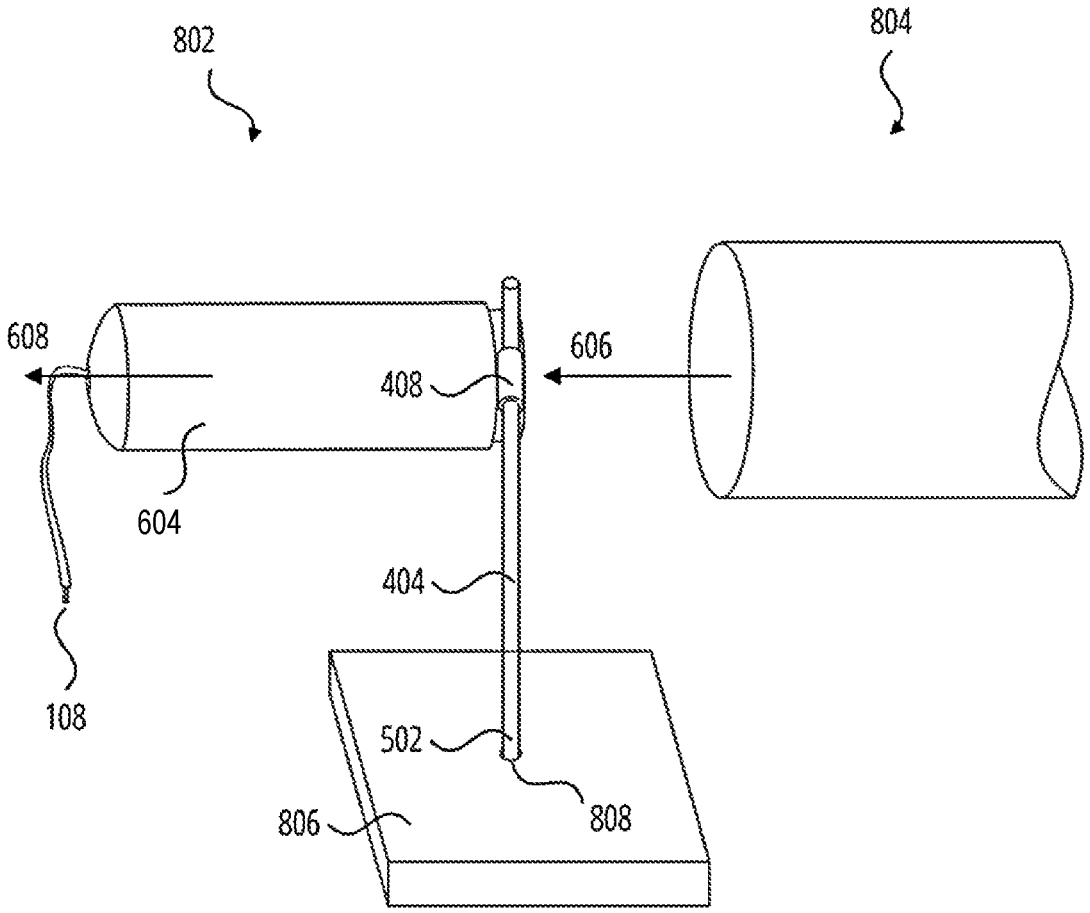
FIG. 8 is a perspective view of an assembled device.

Referring to FIG. 8, a fully assembled filter device 802 is shown installed adjacent to an exhaust pipe 804. As depicted, lower end 502 of pole 404 is inserted into a base 806 that has a cooperating hole 808 to accommodate the lower end 502. The assembled filter device 604 is secured at an appropriate height and distance from an exhaust pipe 804. The base 806 allows the fully assembled device 802 to be used on a hard surface.

Figure 9:
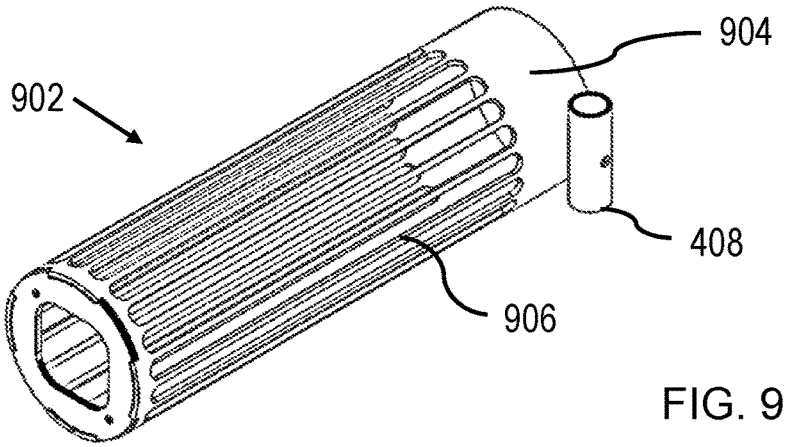
FIG. 9 is a perspective view of an alternative filter support cylinder.
Figure 10:
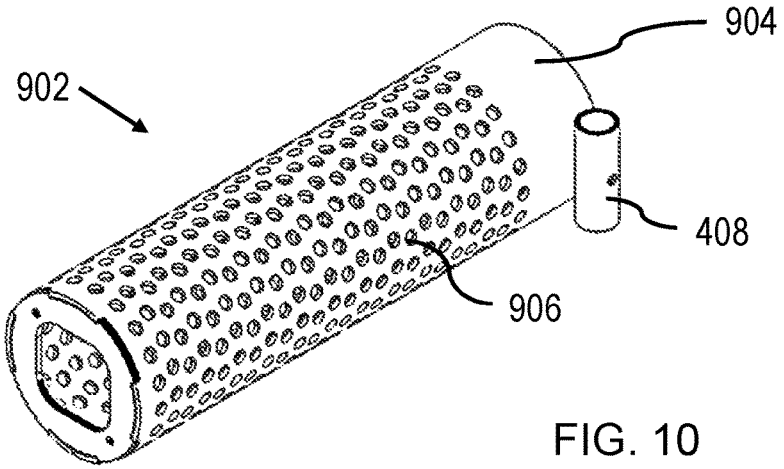
FIG. 10 is a perspective view of a further alternative filter support cylinder.
Figure 11:
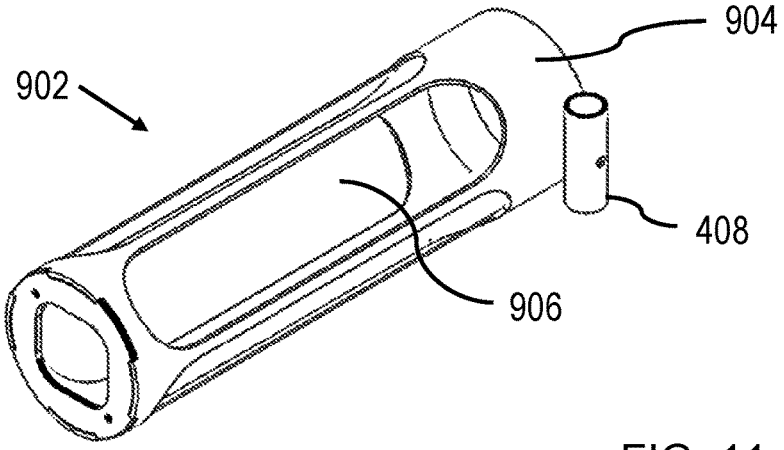
FIG. 11 is a perspective view of a further alternative filter support cylinder.

Referring to FIG. 9-11, an alternative exterior sleeve 902 is shown, having a sleeve body 904 and openings 906. In FIG. 9, opening 906 are elongate slots that extend along a length of sleeve body 904. In FIG. 10, openings 906 are a series of perforations distributed along the length of rigid body 904. In FIG. 11, openings 906 are sufficiently large to accommodate a mesh screen (not shown). The mesh screen may be replaceable in the even that it becomes soiled. Exterior sleeve 902 is intended to combine some of the features of supporting hardware 402, where sleeve body 904 may be sufficiently rigid to support filter sleeve 102 (not shown) in a lateral position, and pole support 408 may be securely attached to sleeve body 904.

A method of using the device to remove particulate matter from exhaust gases will now be discussed with reference to FIG. 8. Device 802 is assembled as described above with assembled filter device 604 secured at an appropriate height on pole 604 so that it is aligned with exhaust flow 606 and spaced an appropriate distance from exhaust pipe 804. The height of filter device 604 may be achieved by adjusting collar 406 on pole 404, or by adjusting the height of a telescopic pole. The distance from the exhaust pipe 804 being determined either by inserting the lower end 502 of the pole 404 into the ground, or by use of a base 806 having a cooperating hole 808 that is sized to accommodate the lower end 502 of the pole 404. Filter sleeve 102 is replaceable once fouled. A fouled filter sleeve 102 may be removed, and replaced by a clean filter sleeve 102 by passing cord 108 through hole 302 of exterior sleeve 202 and pulling cord 108 to help seat clean filter sleeve 102 within exterior sleeve 202.

While a majority of exhaust gases pass through the sidewalls of filter sleeve 102 and Hole 302 also allows a portion of the exhaust gases to pass therethrough to relieve some air pressure within filter sleeve 102

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

The invention claimed is:

1. A device for filtering particulate matter from exhaust gases, the device comprising:

a supporting structure comprising an elongate support;

a filter sleeve comprising a tubular shaft of filter material, the tubular shaft having an open first end, and a closed second end;

an exterior sleeve that defines an internal cavity that is sized and proportioned to receive the filter sleeve, the exterior sleeve having an open first end, a side wall that surrounds the internal cavity, and a second end, wherein the side wall is air permeable, and the second end comprises an end wall that defines a hole for filtered exhaust gases to pass through; and an attachment that mounts the exterior sleeve to the supporting structure.

2. The device of claim 1, further comprising a base that supports a lower end of the elongate support.

3. The device of claim 1, wherein the elongate support is length adjustable.

4. The device of claim 1, wherein the filter sleeve further comprises a cord having a diameter less than the hole, the cord being insertable through the hole to assist insertion of the filter sleeve into the exterior sleeve.

5. The device of claim 1, wherein the exterior sleeve is fabricated from cotton, canvas, linen, or denim.

6. The device of claim 1, wherein the exterior sleeve comprises a rigid or semirigid sleeve having apertures formed therein.

7. The device of claim 1, wherein the supporting structure comprises a hollow tubular collar that engages the open first end of the exterior sleeve, the attachment being attached to the hollow tubular collar.

8. The device of claim 7, wherein the attachment is tubular and sized to accommodate the elongate support, the elongate support being fixed in place by a clamp.

9. The device of claim 1, wherein the filter sleeve is fabricated from polyester.

10. The device of claim 9, wherein the polyester is 100% non-woven polyester fiber bonded together and has an initial resistance of 0.11 wg @ 300 fpm.

11. The device of claim 1, wherein the attachment comprises a tubular seam surrounding a diameter of the exterior sleeve and a fastener that is sized and proportioned to be threaded through the tubular seam and secured around a collar carried by the supporting structure.

12. The device of claim 11, wherein the fastener is a zip-tie.

13. A method of removing particulate matter from exhaust gases of an engine, the method comprising:

providing a filter sleeve received within an exterior sleeve, wherein:

the filter sleeve comprises a tubular shaft of filter material, the tubular shaft having an open first end, and a closed second end; and the exterior sleeve defines an internal cavity that is sized to receive the filter sleeve, the exterior sleeve having an open first end, and a second end, the second end comprising an end wall that defines a hole for filtered exhaust gases to pass through;

positioning the exterior sleeve in line with an exhaust pipe of the engine emitting the exhaust gases; and using an elongate support, supporting the exterior sleeve on a ground surface such that the exterior sleeve and filter sleeve are supported by the elongate support separately from the exhaust pipe.

14. The method of claim 13, wherein a lower end of the elongate support is inserted into a ground surface.

15. The method of claim 13, wherein the elongate support is positioned by securing a lower end of the elongate support to a base, and the base is placed on a ground surface.

16. The method of claim 13, wherein the open first end of the exterior sleeve and the open first end of the filter sleeve are spaced from an output end of the exhaust pipe.

* * * * *